United States Patent [19]

Brown

[11] Patent Number: 4,706,721

[45] Date of Patent: Nov. 17, 1987

[54] DOUBLE-DRUM WOOD CHIPPER APPARATUS

[76] Inventor: Kenton J. Brown, 5613 Regency Oaks Dr. North, Mobile, Ala. 36609

[21] Appl. No.: 802,495

[22] Filed: Nov. 27, 1985

[51] Int. Cl.[4] ..... B27C 1/00; B02C 18/18

[52] U.S. Cl. ..... 144/174; 241/190; 241/236

[58] Field of Search ..... 241/190, 236, 28; 144/167 R, 173, 174

[56] References Cited

U.S. PATENT DOCUMENTS 3,209,801 10/1965 Little et al. ..... 144/172
3,314,459 4/1967 Beaubien ..... 144/172
3,929,294 12/1975 Cox ..... 241/236
3,991,944 11/1976 Baikoff ..... 241/236
4,399,946 8/1983 Stevenson ..... 241/236

FOREIGN PATENT DOCUMENTS 2065350 5/1973 Fed. Rep. of Germany ..... 144/174

*Primary Examiner*—W. D. Bray

[57] ABSTRACT

A double-drum wood chipper for obtaining wood chips of uniform thickness from logs. Each one of a pair of oppositely rotating, hollow, open ended drums is provided with cutting knives. An aperture through the drum walls is located near each knife for reception of the wood chips. Two knife patterns on the drums are disclosed. The parallel-cutting edge of each knife makes an angle of about 150° with the cutting edge of each of two laterally positioned, integral cross cutting knives.

7 Claims, 11 Drawing Figures

DOUBLE-DRUM WOOD CHIPPER APPARATUS

BACKGROUND OF THE INVENTION

This invention relates to an apparatus for obtaining wood chips from logs, particularly logs which have been debarked. The invention further relates to a process for obtaining wood chips of uniform thickness from logs.

SUMMARY OF THE INVENTION

In the papermaking industry, it is often convenient to form wood pulp using wood chips. Chips of uniform thickness are preferred. Wood chips may be obtained by operating upon logs, particularly debarked logs, by means of knives which move relative to the surface of the logs. Workers in this art have evolved a variety of chipping devices, including so-called drum chippers, i.e., rotating drums whose periphery or whose peripheries are provided with projecting knives. Drum chippers, sometimes termed peripheral chippers, have the potential to produce uniform thickness chips with minimum fiber damage, but the single-drum models of prior constructions have inherent problems. The basic features of a typical such drum chipper are shown in U.S. Pat. No. 3,757,839 issued to Stanley Vanek, hereby incorporated by reference. As can be seen from FIG. 2 of that patent, if the log to be chipped drops onto the drum from a position to the right of axle (3) it will tend to bounce, due to the lifting forces exerted on it by the knives moving upward. Log bouncing results in chips of various thickness. Logs that pass downwardly, to the left of rotating drum (2) into the horn-angle between the drum and the anvil wall (13) tend to rotate around their axes. This rotation also produces variable thickness chips. When the last remaining portion of a log reaches the exit of the chipper, being the opening between the drum and the anvil, long slivers of wood escape from the chipping zone and drop along with the other chips onto a conveyor beneath the chipper. The slivers can be as long as the space between knives on the drum on a line parallel to its axis (12 inches to 18 inches, or more) and as thick as the clearance between the drum's surface and the anvil ($\frac{1}{2}$ inch to $\frac{3}{8}$ inch, or more).

The problem with logs bouncing on the surface of the drum was realized and addressed in U.S. Pat. No. 3,155,130, issued to Logan et al, hereby incorporated by reference. In an attempt to provide a steady feed of logs to the chipper drum, a pull-down conveyor was installed in the log hopper as shown in FIG. 2. Actually, in the few models sold to mills, pull-down conveyors were mounted on both sidewalls of the hoppers, also as shown in this patent. This increased the cost of the chippers and only partially solved the bouncing problem.

SUMMARY OF THE INVENTION

According to the practice of this invention, a novel apparatus and method is disclosed which substantially eliminates the problem of log bouncing. Further, according to the practice of this invention, the problem of slivers of wood escaping between the drum and the anvil of the drum is substantially solved, to thereby insure the production of wood chips of substantially uniform thickness.

The full nature of the invention will be understood from the accompanying drawings and the following description and claims. It should be understood that references in the following description to front, rear, upper and lower are for convenience for description and such terms are not intended to be used in a limiting sense.

DETAILED DESCRIPTION OF THE INVENTION

Figure 1:
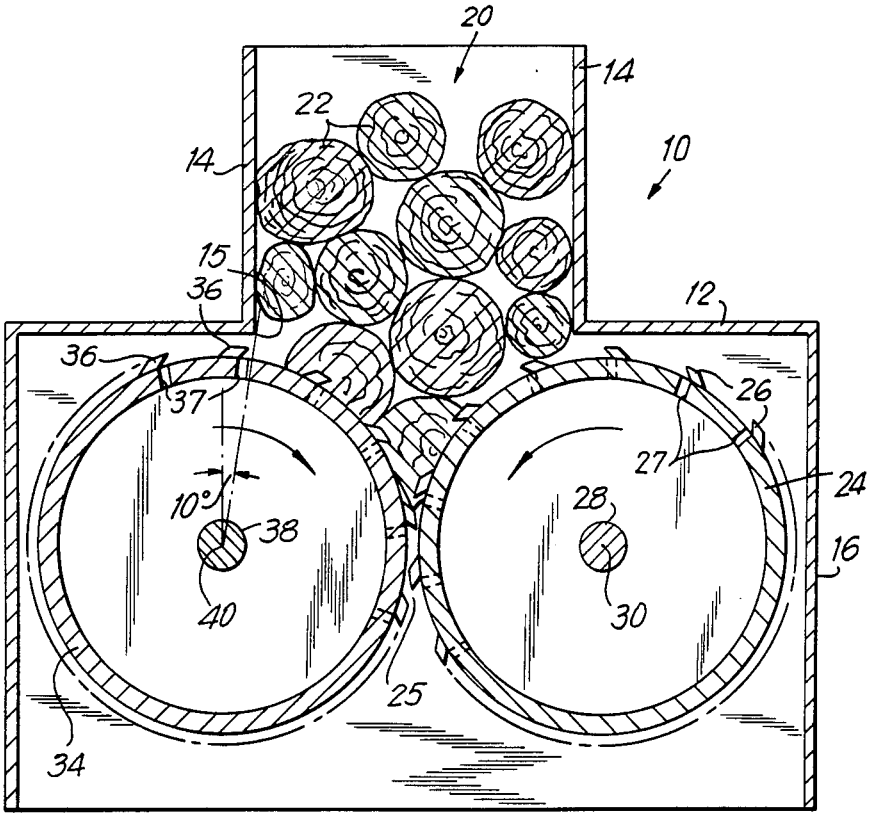
FIG. 1 is a transverse cross-sectional view illustrating the double-drum wood chipper apparatus of this invention.

Referring now to FIG. 1 of the drawings, the numeral 10 denotes generally the double-drum wood chipper apparatus of this invention and includes a housing having horizontal wall portions 12, parallel, vertical walls 14 and parallel, vertical lower walls 16. Vertically extending walls 14 define a hopper denoted generally by the numeral 20 for holding a supply of logs each identified by the numeral 22. The reader will understand that the logs are positioned within hopper 20 with their longitudinal axes perpendicular to the plane of the paper.

The numeral 24 denotes one of a pair of oppositely rotating, hollow drums, the drums each being open at at least one end. The numeal 26 denotes any one of a plurality of cutting knives suitably carried on the cylindrical wall of the drum. The numeral 27 denotes any one of a plurality of wood chip receiving apertures extending completely through the hollow drum 24, each aperture 27 being placed in front of (relative to the direction of drum rotation) and contiguous to an associated cutting knife 26. Drum 24 is suitably mounted on shaft 28, the shaft rotating about an axis denoted by the numeral 30. The numeral 34 denotes the other one of the pair of oppositely rotating drums, drum 34 similarly carrying a plurality of angularly spaced cutting knives 36, each of the latter having an associated through aperture 37 for the reception of wood chips as will later be described. Drum 34 is suitably mounted on rotating shaft 38, the latter rotating about an axis indicated by the numeral 40. The numeral 25 denotes the nip zone between the drums. As shown at FIG. 1, an imaginary line between the lowermost portion 15 of either hopper wall 14 and the axis of rotation of either shaft 30, 40 makes an angle of 10° (5° to 15° being the preferred range) with the vertical. The walls 14 are thus between the shafts 30, 40 thereby insuring that any log contacting a drum surface will tend to fall towards nip 25. As indicated by the curved arrows, the drums rotate in opposite direction such that their facing surfaces at nip zone 25 both travel downwardly.

Figure 2:
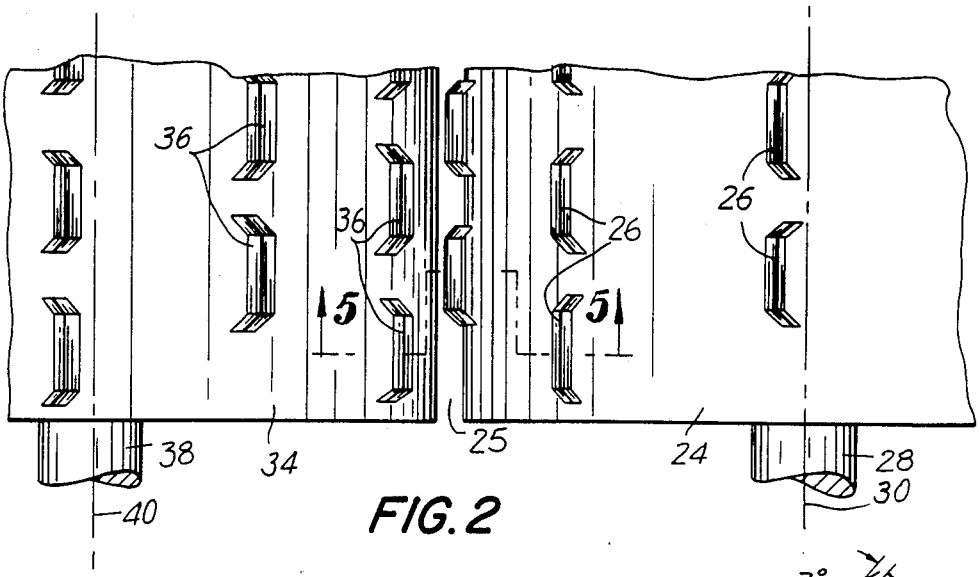
FIG. 2 is a partial plan view of the rotating drums illustrated at FIG. 1, according to a first embodiment of the drums.

Referring now to FIG. 2 of the drawings, a partial plan view of the drums shown at FIG. 1 is illustrated. The cutting knives are arranged and positioned in straight rows on the circumference of the drum, each row being parallel to an immediately adjacent row, the rows being parallel with respect to the axis of rotation of the drum, being axis 30 with respect to drum 24 and axis 40 with respect to drum 34. From a consideration of FIG. 2 it will be seen that the knives of any one row of either drum would be interdigitated with the knives of any next adjacent row, if these two adjacent rows were rotated so as to come together.

Figure 3:
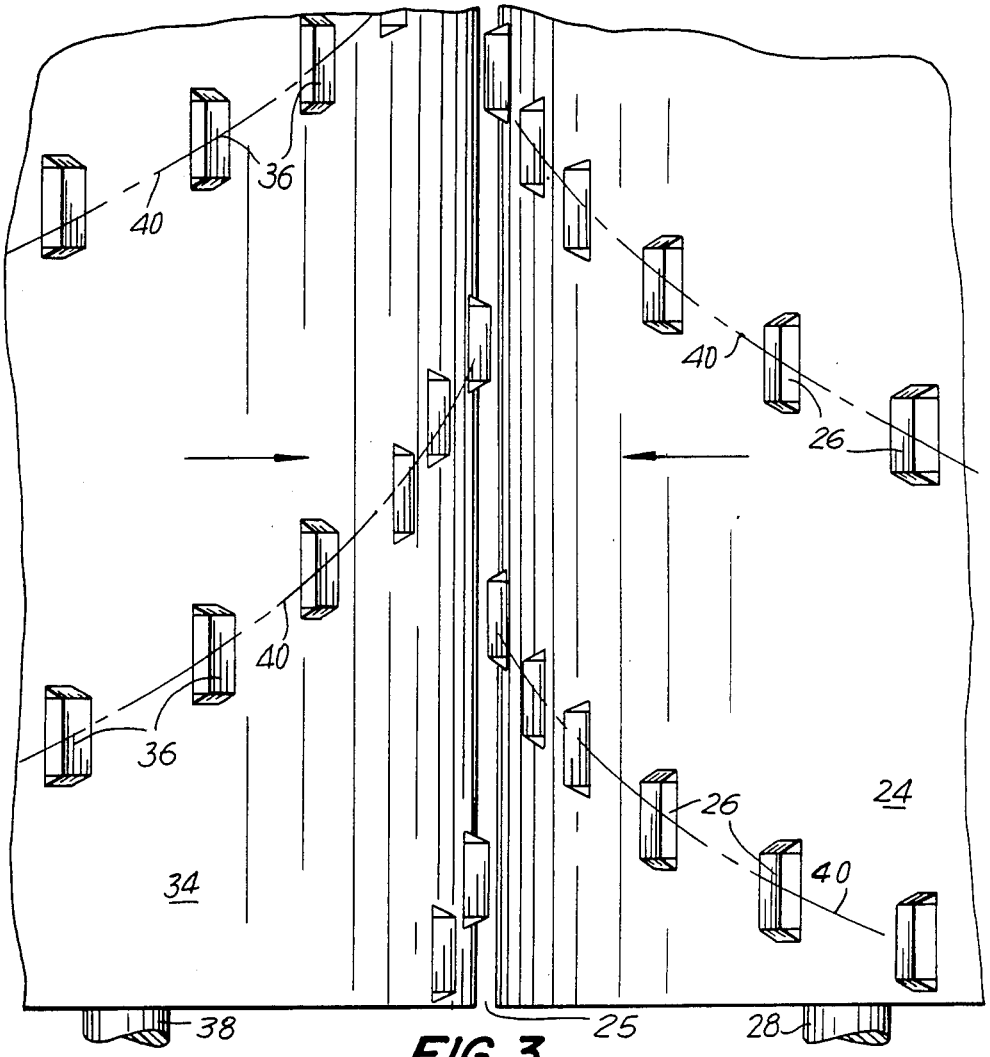
FIG. 3 is a view similar to FIG. 2, showing a second drum modification.
Figure 4:
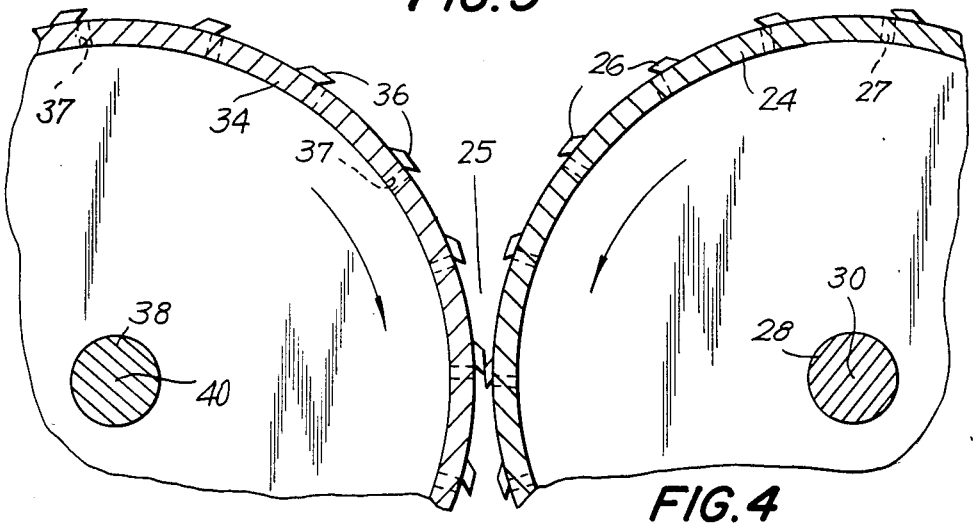
FIG. 4 is a partial transverse cross-sectional view showing the drum configuration of FIG. 3.
Figure 6:
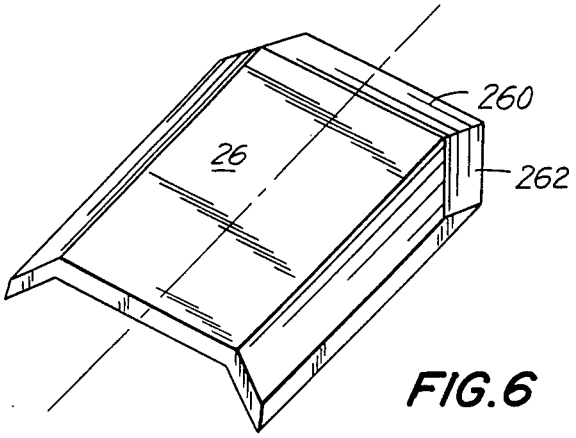
FIG. 6 is a perspective view of the drum carried knives of this invention.

Referring now to FIG. 3, an alternative knife mounting configuration is illustrated. The drum and knife construction themselves are the same as that described with respect to FIGS. 1 and 2, except that the knives on each drum are arranged in a plurality of helical paths. Thus, the numeral 40 at FIG. 3 denotes any one of a plurlaity of helical paths on the drum surfaces along which and on which knives 26, 36, are positioned. As easily seen at FIG. 3, the helices of the two drums are interdigitated, i.e., spaced from each other relative to the parallel axes of the drums. As indicated at FIG. 4, at the nip 25 between rolls 24 and 34, homologous or corresonding knives on opposite sides of the nip are at substantially the same angular positions, as distinguished from the embodiment of FIG. 2 wherein, at the nip 25, the knives alternate (are interdigitated) at any given axial location along the drums.

Figure 5:
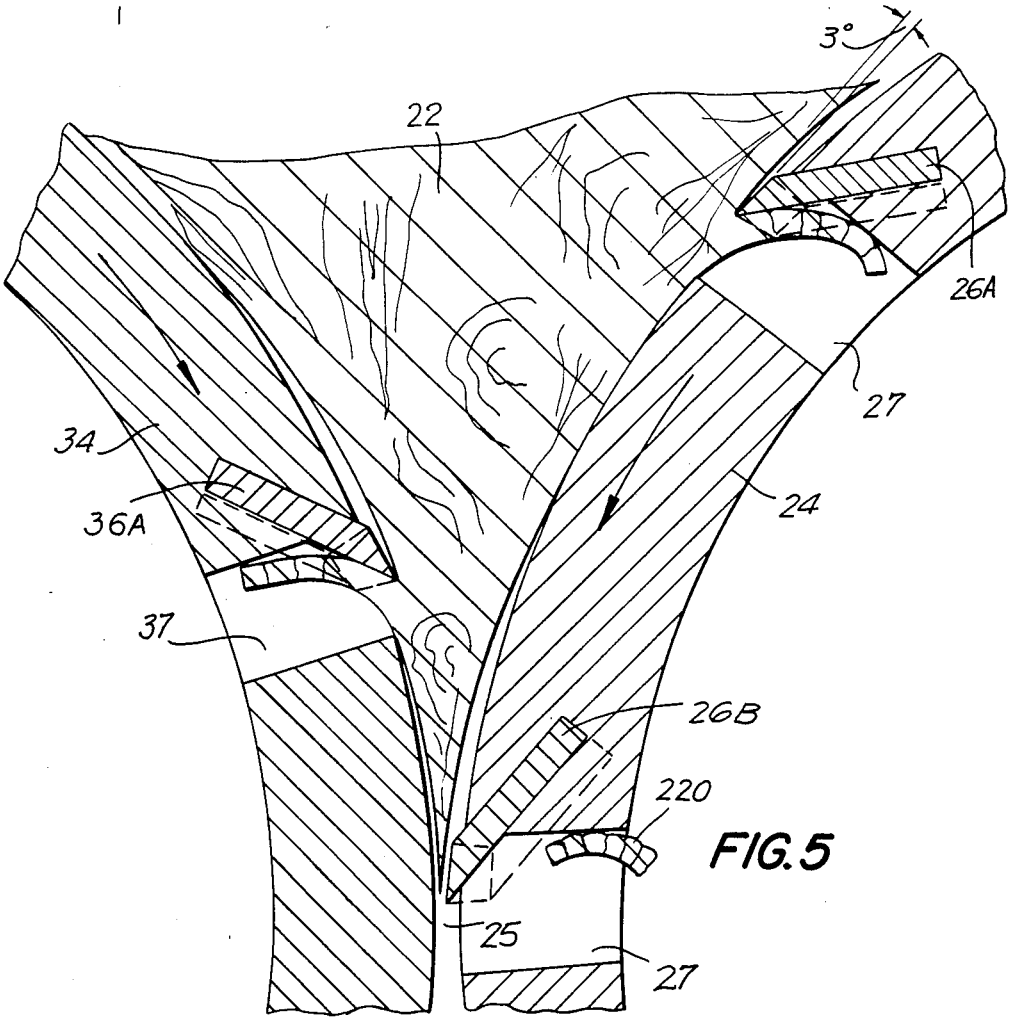
FIG. 5 is a partial transverse cross-sectional view illustrating the cutting or chipping action of the apparatus illustrated at FIG. 1, taken along section 5—5 of FIG. 2.

Referring now to FIG. 5 of the drawings, the cutting action of the knives and the formation of chips in the nip 25 is illustrated. One portion of a log 22 is illustrated as extending into the nip 25 between the rolls. Knife 26-A on drum 24 is seen as cutting into a portion of log 22. Knife 36-A of drum 34 is, likewise, seen as cutting into a portion of log 22, but from the opposite side. Knife 26-B has cut completely through its corresponding portion of long 22 to thereby define a complete chip 220, this chip illustrated as having passed almost completely through the aperture 27 which is associated with knife 26-B. The reader will readily image that with continued rotation of the drums in the indicated direction, a corresponding wood chip would be formed by knife 36-A, this chip passing through opening 37 associated with that knife and falling into the interior of drum 34. Thus, the interior of each of drums 24 and 34 continuously receive a supply of wood chips from apertures 27 and 37, respectively.

As each knife in the upper portion of nip 25 approaches the narrowest part of the nip, it moves towards the opposite drum surface. The opposite drum surface thus functions as an anvil. The drums are rotating at the same speed and there is no bouncing or rotating movement of the logs with respect to either drum surface. The path of motion of the cutting knives is such as to tend to pull the logs down against the drums so that the logs can neither bounce nor rotate. As indicated at FIG. 1, some logs will be consumed on the upper surfaces of the drums and will hence never reach the nip zone 25.

As is conventional, the knives are oriented on the drum surfaces in such a manner to yield a relief angle of about 3° between the surface of the wood being cut by the knife and that face of the knife opposite the knife-engaged wood. This relief angle is indicated at FIG. 5. The manner of mounting the knives on the drums forms no part of this invention and has accordingly not been illustrated. Any conventional mounting manner may be employed.

Figure 7:
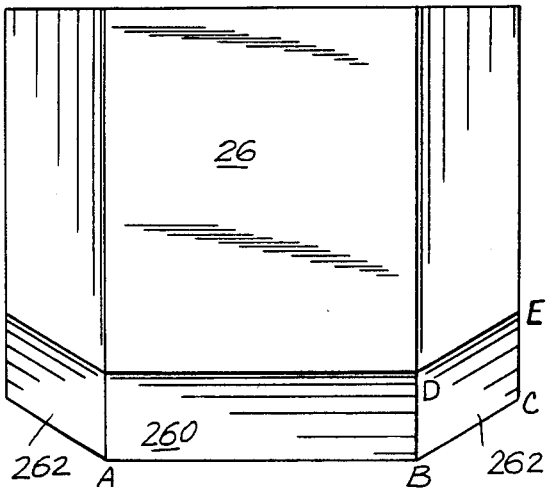
FIG. 7 is a plan view of the knife of FIG. 6.
Figure 9:
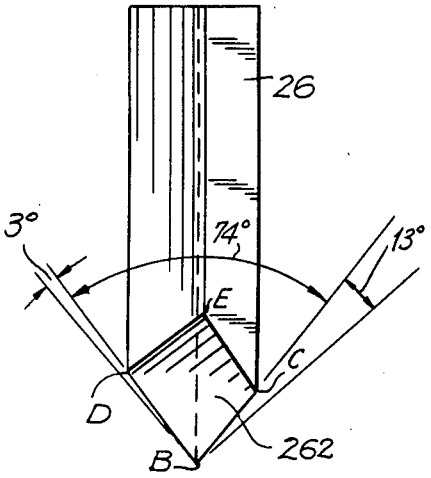
FIG. 9 is a side elevational view of the knife of FIG. 7 taken at right angles to the longitudinal axis of the knife.
Figure 8:
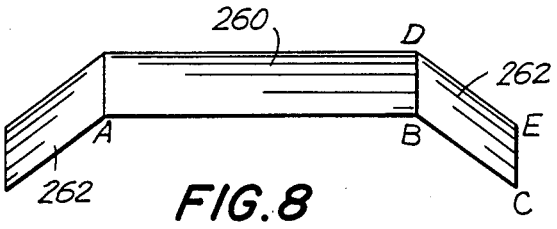
FIG. 8 is a front elevational view of FIG. 7.

Referring now to FIGS. 6–9, the configuration of the knife 26 is illustrated, this configuration being the same, of course, for the knife 36 of drum 34. The leading, cutting edge of each knife, termed the parallel cutting edge is denoted by edge A, B, while the face or surface of the knife which is opposite to that portion of the logs and which are cut by the parallel cutting edge of the knife is denoted by the numeral 260. Cross cutting faces 262 are defined by swept backed portions, the corners of which are denoted by B, D, E, C. This face portion is swept back towards the rear of the knife so that the angle between edges AB and BC is about 150°, as indicated at FIG. 7. FIG. 9 also indicates the (conventional) relief angle of 3° between surface 260 and the surface of the log which has been cut by the cutting edge of the knife, this latter surface indicated by the arrow extending from the cutting edge denoted by B at FIG. 9. FIG. 9 also illustrates another important feature of this invention. In addition to the relief angle of 3° between the surface of the wood after cutting and the knife surface trailing the cutting edge, to thereby insure that the wood does not ride on the knife, a similar relief angle between the wood and the cross cut knife surfaces 262 has been identified in developing this invention. Namely, the leading cutting edge BC of the cross cut knife must be swept back to an angle of about 74° as shown in FIG. 9 between its edge BC and the trailing surface 260 of the parallel-cutting knife. This angle may be varied by as much as 2° in either direction. This angle was found experimentally to produce minimal fiber damage during formation of the wood chips. By detaching the fibers from the wood with the parallel-cutting edge prior to cutting off the chips at an angle to the fibers, the probability of producing longitudinal compression failures in the fiber walls was avoided.

The angle at which the longitudinal axes of knives are placed in the drum walls will now be apparent. Namely, the surface 260 of each knife makes an angle of about 3° with the tangent to the drum circumference at each knife location. Accordingly, each knife is mounted in its corresponding drum wall such at its surface 260 makes an angle of about 87° with a radius line from the center of rotation (20, 40) of the respective drum. The angle which face 260 makes with the underside of the knife (being the cutting angle of parallel cutting edge AB) is about 35°, while the angle face 262 makes with the underside of its portion of the knife (being the cutting angle of cross-cut edge BC) is about 30°.

Figure 10:
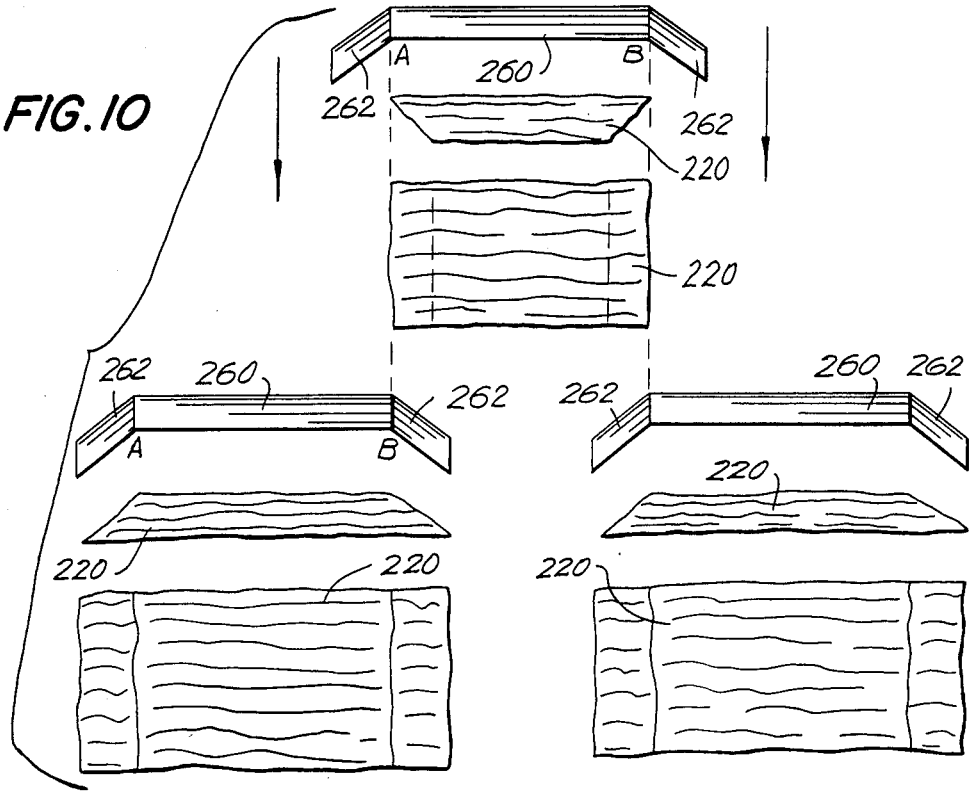
FIG. 10 illustrates the cutting action to form the wood chips in the embodiment of FIG. 1.
Figure 11:
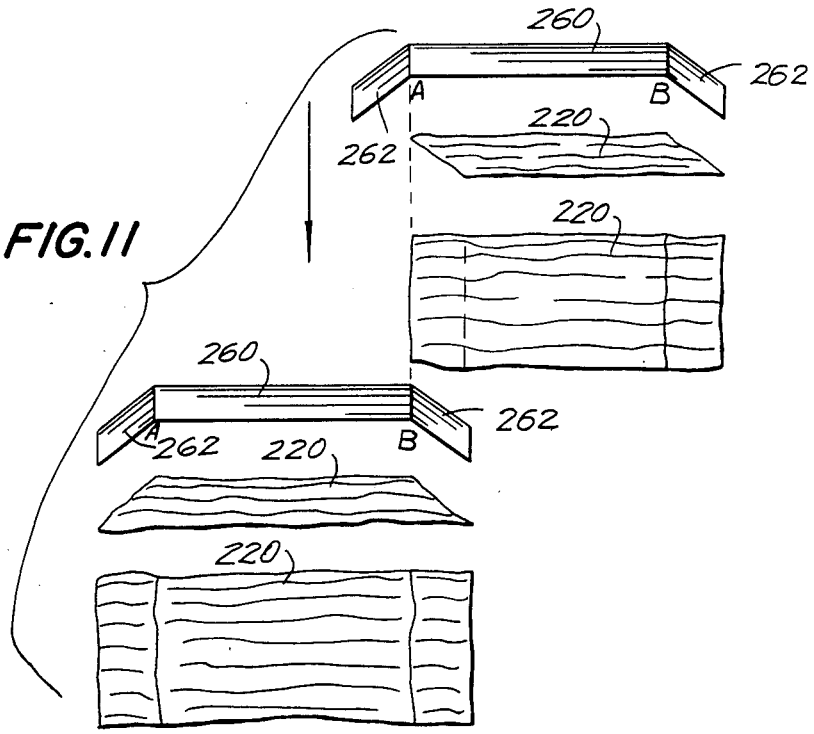
FIG. 11 illustrates the cutting action to form the wood chips in the embodiment of FIG. 3.

Referring now to FIGS. 10 and 11, an illustration of the mode of formation and the general shape of the wood chips for the two embodiments described is illustrated. In FIG. 10, two of the knives of one of the rolls 24, 34, being on a single line (as illustrated at FIG. 2) are illustrated and immediately beneath them are end and top views of these chips. The upper portion of FIG. 10 indicates a following and interdigitated knife, on the the same drum, with end and top views of a typical chip cut by that knife indicated by the numeral 220.

Referring now to FIG. 11, the left portion of the Figure indicates any of the knives on drums 24, 34 arranged in the helical pattern of FIG. 3, with a typical wood chip 220 shown below this knife, both in end and top views, respectively. The upper right hand portion of FIG. 11 indicates a following knife, on the same helical path and on the same drum, and beneath this knife is also illustrated a typical wood chip 220, also both in end and top views.

The interdigitation of and alignment between the knives in the configuration of FIG. 2 is indicated at FIG. 10 by the dashed vertical lines between the edges A, B of the cutting faces of the knives. The single, corresponding vertical dashed line of FIG. 11 indicates the staggered relation of the knives on any helix 41 of the knife configuration of the embodiment of FIG. 3.

What is claimed is:

1. A double-drum wood chipper apparatus for making wood chips from logs, the apparatus including, a pair of hollow drums mounted on parallel axes to thereby define a nip portion between their cylindrical surfaces, each drum having an open end, each drum mounted for rotation such that the oppositely facing nip surfaces rotate in the same direction, each drum carrying a plurality of angularly spaced knives extending outwardly from its cylindrical surface and being slanted in the direction of its respective drum rotation, a wood chip receiving aperture extending through each drum at a location contiguous to each knife, a vertically disposed log supply hopper having spaced apart vertically disposed walls and positioned above the drums, at least the lower portions of said hopper walls being spaced apart a distance less than the distance between the said parallel axes and located substantially centrally between said parallel axes.

2. The apparatus of claim 1 wherein the knives are positioned so as to define a plurality of helices on each drum, the helices of one drum being interdigitated with the helices of the other drum.

3. The apparatus of claim 2 wherein any knife of one helix of either drum has an angularly homologous knife on the other, homologous helix of the other drum.

4. The apparatus of claim 1 wherein the knives on either drum are positioned so as to define a plurality of angularly spaced straight rows running parallel to the axis of rotation of that drum.

5. The apparatus of claim 4 wherein the knives of any row of either drum are interdigitated with respect to the knives of any next angularly adjacent row at any axial position along the nip between the drums.

6. The double drum wood chipper of claim 1 wherein each cutting knife having a central, parallel cutting edge and surface associated therewith, the ends of the parallel cutting edge each having an integral, swept back cross cutting knife having a cutting edge and associated surface, the angle, viewed transversely of the knife, between the surface associated with the parallel cutting edge and the cutting edge of each swept back cutting knife being about 74°.

7. The double drum construction of claim 6 wherein the angle, in plan view of the knife, formed between the central, parallel cutting edge and the cutting edge of each swept back cross cut knife is about 150°.

* * * * *

UNITED STATES PATENT AND TRADEMARK OFFICE

CERTIFICATE OF CORRECTION

PATENT NO. : 4,706,721

DATED : November 17, 1987

INVENTOR(S) : Kenton J. Brown

It is certified that error appears in the above-identified patent and that said Letters Patent is hereby corrected as shown below:

On the Title Page add:

[73] Assignee: International Paper Co., New York

Signed and Sealed this

Twentieth Day of September, 1988

*Attest:*

*Attesting Officer*

DONALD J. QUIGG

*Commissioner of Patents and Trademarks*